US006619048B1

(12) United States Patent
Gonzalez

(10) Patent No.: US 6,619,048 B1
(45) Date of Patent: Sep. 16, 2003

(54) SPECIAL EFFECTS CLOUD GENERATION SYSTEM

(76) Inventor: Alejandro J. Gonzalez, P.O. Box 211, Key Biscayne, FL (US) 33149

( * ) Notice: Subject to any disclaimer, the term of this patent is extended or adjusted under 35 U.S.C. 154(b) by 0 days.

(21) Appl. No.: 10/215,987

(22) Filed: Aug. 9, 2002

Related U.S. Application Data

(63) Continuation of application No. 09/603,284, filed on Jun. 26, 2000, now Pat. No. 6,430,940.
(60) Provisional application No. 60/173,656, filed on Dec. 30, 1999.

(51) Int. Cl.[7] ..... F17C 9/04
(52) U.S. Cl. ..... 62/50.4; 62/52.1
(58) Field of Search ..... 62/45.1, 47.1, 62/48.1, 50.1, 50.2, 50.4, 52.1, 78

(56) References Cited

U.S. PATENT DOCUMENTS 4,836,446 A * 6/1989 Chanel ..... 239/2.2
5,331,822 A * 7/1994 Belliveau et al. ..... 62/168
5,649,427 A * 7/1997 Sawada et al. ..... 62/50.2
6,202,707 B1 * 3/2001 Woodall et al. ..... 141/1
6,430,940 B1 * 8/2002 Gonzalez ..... 62/50.2

* cited by examiner

*Primary Examiner*—Denise L. Esquivel
*Assistant Examiner*—Malik N. Drake
(74) *Attorney, Agent, or Firm*—Malloy & Malloy, P.A.

(57) ABSTRACT

An effects generation system structured to produce a controlled special effects cloud and comprising a cryogenic fluid source including a container wherein a quantity of a cryogenic fluid is stored. The container includes a fluid outlet and a fluid inlet, the fluid inlet being disposed in fluid flow communication with a pressurization assembly that is structured to maintain an outflow of the cryogenic fluid, under pressure, through the fluid outlet and into a delivery assembly operatively connected with the fluid outlet and structured to deliver the cryogenic fluid into a predetermined area through a plurality of delivery ports and into reactive proximity with a quantity of a reactive fluid so as to bring about a phase change in the reactive fluid sufficient to result in the formation of the special effects cloud.

19 Claims, 1 Drawing Sheet

SPECIAL EFFECTS CLOUD GENERATION SYSTEM

CLAIM OF PRIORITY

The present application is a Continuation application of previously filed, now pending application having Ser. No. 09/603,284, which was filed on Jun. 26, 2000, now U.S. Pat. No. 6,430,940 which is set to mature in due course and which is based on and claims priority under 35 U.S.C. Section 119(e), to provisional patent application having been filed in the U.S. Patent and Trademark Office, having Ser. No. 60/173,656 and a filing date of Dec. 30, 1999.

BACKGROUND OF THE INVENTION

1. Field of the Invention

The present invention relates to a special effects cloud generation system structured to produce a preferably controlled and concentrated cloud or fog like effect, in a defined area, and in a manner which is substantially regulatable and achieves evenly pressurized dispersement. The system further promotes a high degree of manageability of the generated effects cloud, maximizes the use of the cryogenic components for actual cloud generation, and is substantially safe to employees in a populated area. Additionally, the effects generation system relates to the production of the special effect cloud which in addition to enhancing an appearance of a particular location, is also structured to quickly and effectively cool the location in a cost effective and repeatable manner.

2. Description of the Related Art

In many fields of art, but especially in the fields of art relating to dance club productions and staging productions, it is desirable to utilize cloud or fog type effects in order to enhance the look and/or ambiance of the particular location. Traditionally, such cloud type effects are generated utilizing devices often referred to as "fog machines", wherein a water or oil based chemical solution is atomized and heated, spraying a cloud into the air. This cloud, however, is difficult to control or direct, often has many impurities associated therewith, and causes chemicals to linger in an area for an extended period of time. In addition to those types of fog machine structures, other more advanced machines have also been utilized in an attempt to produce a special effects cloud through cooling. In such devices, water vapor or another chemical is atomized and super cooled, such as with dry ice or another cold material, in order to produce a fog type condensation that stays low to the ground. Unfortunately, such conventional systems are often substantially difficult to control and regulate in order to provide a sufficient effect, and produce a fog that merely migrates over an area in an uncontrolled fashion. Furthermore, such existing systems often the associated draw back of only moderately condensing the water vapor or atomized chemical, such that "fog" produced tends to be damp and/or wet, often creating a dampness or wetness on contacted surfaces, such as on a dance floor, which creates a potential hazard, and tends to create an uncomfortable, humid environment for persons in the area. As a result, it would be desirable to develop a way of generating a more concentrated cloud or fog, which will minimize water build up in a particular location and will maintain and/or enhance the comfort level of individuals in a location wherein the effect is generated.

Cryogenic fluids are generally a class of fluids formed by maintaining normally gaseous elements at a sufficiently low temperature and/or high pressure such that it can exist in generally a liquid form. Such cryogenic fluids can therefore include liquid nitrogen, argon, oxygen, helium, liquid carbon dioxide, and a variety of other normally gaseous materials and elements maintained in liquid form. Because of the difficulties normally associated with maintaining a very low temperature environment, such cryogenic fluids are typically contained in secure containers having a vacuum jacketed or encased structure. This vacuum jacketing functions to help maintain the desired liquid state of the cryogenic fluid, while also providing for a degree of transportability and usability of the container wherein the cryogenic fluid is stored, by reducing the need to constantly keep the container in a highly refrigerated area.

Of course, a problem that results from maintaining such cryogenic fluids in the necessary liquid state relates to the dispensing of quantities of the cryogenic fluid as needed. In particular, if the container is merely opened in a standard environment, the liquid will not "pour" out like a conventional liquid, but rather, the liquid will revert to its gaseous state immediately. Accordingly, it has been necessary to develop an effective mechanism for delivering the cryogenic fluid substantially in its liquid state. Presently, vacuum jacketed cryogenic fluid containers are equipped with self pressurizing assemblies so as to provide for the appropriate delivery of the cryogenic fluid from the container in liquid form when needed. Such self pressurization generally involves the expansion of a quantity of the cryogenic fluid in its liquid state, such as by removing it from its contained environment, so as to result in the formation of a quantity of gas, that is then returned into the container to achieve necessary outflow and delivery pressurization of the cryogenic fluid, preferably in its liquid state. As a result, the pressurized gas which result from the expansion of the cryogenic fluid in liquid state serves to push remaining amounts of useable cryogenic fluid from the tank for effective delivery and utilization. While such a self pressurization delivery technique may be sufficient in some applications for the cryogenic fluid, in the field of effects generation, such self pressurization is seen to be less effective than desirable.

In particular, such self pressurization is only capable of achieving limited amounts of outflow pressurization at a given time, based upon the amount of liquid that is allowed to expand into its gaseous state. Accordingly, the outflow pressurization is not continuous, which among other problems can result in uneven outflow at different delivery locations, and cannot be effectively regulated, such as to increase or decrease the delivery amounts. Furthermore, as the cryogenic fluid itself is being used for pressurization, quantities of the often expensive cryogenic fluid are used up and cannot be utilized for actual effect generation. As a result, it would be beneficial to provide a cloud effect generating system which is capable of utilizing cryogenic fluid in a manner which can deliver the cryogenic fluid in a necessary state to a desired effect location in a uniform, controllable, and continuously pressurized state, which does not compromise the quality and/or effectiveness of the cryogenic fluid, and does not result in the waste of often costly cryogenic fluid for self pressurization.

SUMMARY OF THE INVENTION

The present invention relates to an effects generation system structured to produce a controlled special effect cloud at a particular location. In particular, the effects generation system includes a cryogenic fluid source. Preferably, the cryogenic fluid source includes at least one container in which a quantity of cryogenic fluid, such as preferably liquid nitrogen is contained in its liquid state. Furthermore, the cryogenic fluid source includes at least a fluid outlet, from which a preferably pressurized flow of the cryogenic fluid emerges for distribution, as well as a fluid inlet, such as a "vent" valve of the container.

Specifically, the present system also preferably includes a pressurization assembly coupled at a fluid inlet. In particular, the pressurization assembly is operatively associated with the cryogenic fluid source, and is structured to selectively maintain an outflow of the cryogenic fluid, under pressure, such as from the container. As will be described, this is preferably achieved by pressurizing the interior of the container and generally pushing the cryogenic fluid out. The outflow of fluid passes through the fluid outlet of the cryogenic fluid source and through a delivery assembly.

The delivery assembly is operatively connected with the fluid outlet and is structured to receive and deliver the pressurized outflow of the cryogenic fluid to a desired area where the effect is to be generated, preferably in a prearranged and controllable array. Along these lines, the delivery assembly preferably includes a plurality of delivery ports. Based at least in part on the functioning of the pressurization assembly, however, a substantially continuous pressure of the outflow of cryogenic fluid is maintained, and equalization of the fluid flow pressure at each of the delivery ports of the delivery assembly is attained. As a result, the cryogenic fluid is delivered to a desired area in a substantially even and uniform manner that can be more effectively controlled and utilized.

The effects generation system of the present invention further includes a quantity of reactive fluid. The reactive fluid is disposed in reactive proximity with the cryogenic fluid being delivered into the desired area, such as from the delivery ports. Moreover, the reactive fluid is structured and disposed such that it will interact with the delivered cryogenic fluid, the cryogenic fluid at least partially causing a phase change in the reactive fluid. It is the phase change exhibited by a volume of the reactive fluid that results in the formation of the special effect cloud. Preferably, the reactive fluid includes water molecules, such as provided by a steam generator and/or existing as humidity in the ambient air at the delivery area.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figures 1, 2:
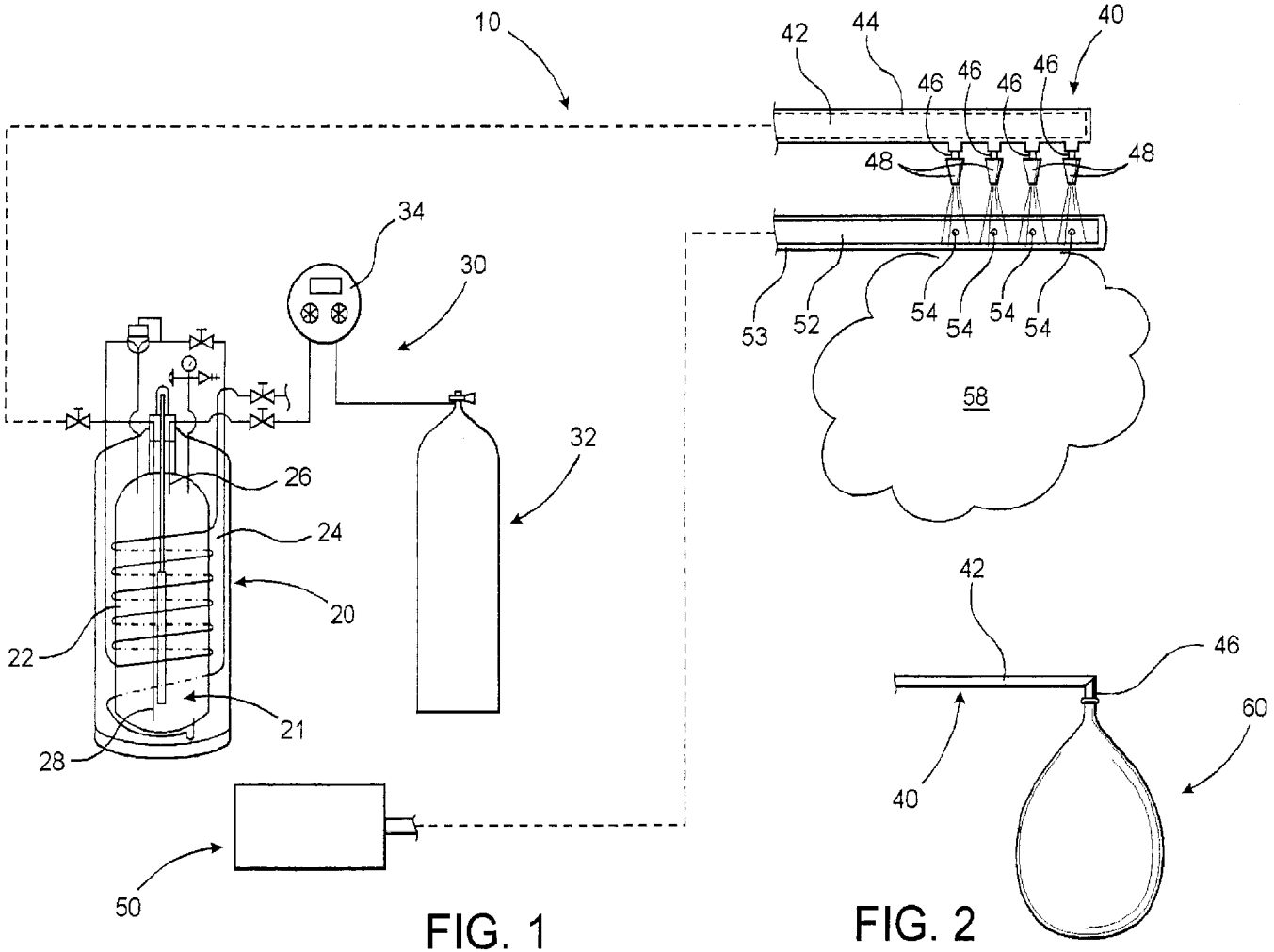
FIG. 1 is a schematic illustration of an embodiment of the effects generation system of the present invention.
FIG. 2 is an isolated view illustrating the utilization of a fluid collection assembly in connection with the effects generation system of the present invention.

As shown throughout the Figures, the present invention is directed towards an effects generation system, generally indicated as 10. In particular, the effects generation system is configured preferably to produce a controlled special effect cloud in a defined area, such as on a stage or in a room. Moreover, the system 10 of the present invention is configured to produce that effect cloud in a safe manner which can also function to effectively cool a delivery area.

The effects generation system 10 of the present invention includes a cryogenic fluid source 20. In particular, the cryogenic fluid source 20 preferably includes a quantity of cryogenic fluid contained in a useable and distributable form. Furthermore, although a variety of different cryogenic fluids may be incorporated into the present invention, in the illustrated embodiment, the cryogenic fluid includes liquid nitrogen. Specifically, nitrogen, as with other cryogenic fluids, typically exists in a gaseous state. When, however, the gas is substantially cooled and/or is subjected to a pressure increase, the gas is transformed into a liquid state, which is the preferred state for the cryogenic fluid within the context of the present invention. By way of example, the cryogenic fluid may also include liquid carbon dioxide, liquid air, and a variety of other compounds which exist in a substantially cold, yet preferably fluid state.

To effectively contain the cryogenic fluid, the cryogenic fluid source 20 also preferably includes at least one container 21. The container 21 is preferably of strong stainless steel, rigid construction which is able to store and contain the cryogenic fluid, maintaining its substantially cold state. Exemplary of the types of containers which may be preferred are the cryogenic fluid containers sold under the trademarks Dura-Cryl or Cryo-Cyl.

The container 21 preferably includes an open interior chamber 22, wherein the cryogenic fluid is actually maintained, as well as a vacuum chamber 24 surrounding the interior chamber 22. The vacuum chamber 24 is structured to help preserve the necessary temperature conditions of the cryogenic fluid.

The cryogenic fluid source 20, and preferably the container 21, also preferably includes a plurality of valves and conduits associated therewith so as to preserve the pressurization and stability of the cryogenic fluid contained therein. Among these features are at least one fluid inlet 26, such as that associated with the "vent" valve, and at least one fluid outlet 28, such as that associated with the "liquid valve". The fluid inlet 26 and the fluid outlet 28 are preferably disposed in fluid flow communication with the interior chamber 22 of the container 21. Moreover, in the illustrated embodiment, the fluid outlet 28 and fluid inlet 26 are preferably connected in fluid flow communication with generally opposite ends of the interior chamber 22 of the container 21. For example, in the illustrated embodiment, the fluid outlet 28 is preferably disposed generally near a bottom of the container 21, so as to facilitate the passage of the cryogenic fluid, and preferably the liquid nitrogen, from the container 21. Conversely, the fluid inlet 26 is preferably disposed generally near a top portion of the container 21. Such positioning, although not required, is preferred, as will become apparent, so as to more effectively effectuate the outflow of cryogenic fluid for use in the effects generation. Of course other valves and conduits normally present in such containers for pressure regulation and equalization may still be present. The effects generation system 10 of the present invention further includes a pressurization assembly, generally 30. In particular, the pressurization assembly 30 is operatively associated with the cryogenic fluid source 20, and preferably with the container 21, so as to selectively and variably maintain an outflow of the cryogenic fluid from the container 21 under pressure. Furthermore, the pressurization assembly 30 is preferably structured to maintain a substantially continuous outflow of the cryogenic fluid in order to achieve substantial fluid flow pressure equalization at each of a plurality of delivery ports 46, to be described in further detail subsequently. In the illustrated embodiment, the pressurization assembly 30 is operatively coupled with the container 21 at the fluid inlet 26. Moreover, the pressurization assembly 30 preferably includes a pressurized fluid source 32. The pressurized fluid source 32 preferably includes one or more tanks containing a pressurization fluid, such as a highly pressurized and compressed gas. Furthermore, in the preferred embodiment, the pressurization fluid 32 preferably includes a compatible elemental makeup with that of the cryogenic fluid disposed within the container 21, thereby minimizing and preferably avoiding any contamination of the cryogenic fluid. In particular, the pressurized fluid source 32 is coupled into fluid flow communication, such as by one or more conduits, at the fluid inlet 26 of the cryogenic fluid source 20. In order to generate an outflow of cryogenic fluid from the cryogenic fluid source 20, the pressurization fluid is allowed to flow from the pressurized fluid source 32 into the container 21, accordingly pushing out the cryogenic fluid contained therein and resulting in the outflow of cryogenic fluid through the fluid outlet 28. As a result, although a mixing does not occur, there is at least some contact and/or interaction between the pressurization fluid and the cryogenic fluid. Accordingly, by utilizing compatible elemental makeups, the cryogenic fluid contained within the container 21 is not contaminated by the pressurization fluid and its effectiveness is not generally diminished and/or wasted. By way of example, in the illustrated embodiment wherein the cryogenic fluid includes liquid nitrogen, the pressurization fluid within the pressurized fluid source 32 preferably includes nitrogen gas. Although not preferred or recommended, it is recognized that air under pressure, carbon dioxide, and/or another pressurization fluid could also be utilized, however, the preferred compatible materials are utilized to minimize waste and contamination, especially in light of the often expensive cost of the cryogenic fluid, such as a liquid nitrogen.

Additionally in the illustrated embodiment, the pressurization assembly 30 may also include a pressure regulator 34, at least partially interposed between the fluid inlet 26 of the container 21 and the pressurized fluid source 32. In particular, the pressure regulator 34 is able to monitor the pressurized flow of the pressurization fluid into the container 21 and can also be utilized to adjust that pressure. As can be appreciated, by adjusting the pressure at which the pressurization fluid is allowed to flow into the container 21, the outflow of cryogenic fluid through the fluid outlet 28 can also be regulated. Moreover, utilizing the described pressurization assembly 30, a substantially continuous outflow pressurization can be maintained, thereby keeping the cryogenic fluid in a readily available state which does require recharge or pressurization before use. Also, if a plurality pressurization fluid sources 32 are utilized, they may also be coupled with the pressure regulator 34 and/or be coupled in line with one another, thereby substantially ensuring that a sufficient supply of pressurization fluid is available to maintain a desired degree of outflow of the cryogenic fluid and to ensure substantial equalization during delivery. With particular regard to the equalization requirements, it is recognized that when a flow is initiated, delivery ports which are closest to the cryogenic fluid source 20 will tend to at least initially exhibit an increased fluid flow pressure. Utilizing the preferred system of the present invention, however, a continuous outflow of the cryogenic fluid is maintained, and the fluid flow pressure at each of the delivery ports 46 will eventually and substantially equalize with one another regardless of their disposition relative to the cryogenic fluid source 20.

In order to effectively deliver the cryogenic fluid into a desired area, and preferably in a select and defined pattern or array, the present invention further includes a delivery assembly, generally indicated as 40. The delivery assembly 40 preferably includes at least one elongate delivery conduit 42 having a plurality of delivery ports 46 disposed in fluid flow communication therewith. The delivery conduit 42 is operatively coupled in fluid flow communication with the fluid outlet 28 of the container 21, and as a result the outflow of cryogenic fluid flows into the delivery conduit 42, eventually passing through the one or more delivery ports 46. Additionally, it may also be preferred that the delivery conduit 42 be vacuum jacketed, as at 44, so as to substantially preserve the temperature and state of the cryogenic fluid until passage through the one or more delivery ports 46. In this regard, although complete vacuum jacketing may be provided, it is generally most practical to provide insulating vacuum jacketing up to approximately 10ft from the delivery ports 46.

From the proceeding, it is also recognized that the delivery ports 46 may be disposed in either a scattered formation or in a predefined or variable pattern or array. Furthermore, if desired, selective opening and/or closing of the delivery ports 46 may be provided by conventional valve means, such as through a motorized and/or other actuatable inlet and/or outlet. Additionally, in the illustrated embodiment, each of the delivery ports 46 preferably includes a nozzle 48 operatively disposed thereon. The nozzles 48, which may be separate components or apertures formed directly in the conduits, are configured so as to regulate and/or control the pressurized flow of cryogenic fluid from the delivery ports 46, and to preferably substantially atomize or disperse the outflow of cryogenic fluid into substantially small particles for delivery. Likewise, the one or more nozzles 48 could also be adjustable so as to regulate the outflow of cryogenic fluid as necessary. In this regard, a constant pressurization can be maintained by the pressurization assembly 30 at each of the delivery ports 46. However, in an embodiment wherein a mechanical nozzle is used, through any of a plurality of conventional control mechanisms the delivery ports 46, and in particular the nozzles 48, can be selectively opened, either completely, in gradual or varied amount and/or to achieve specific patterns.

The effects generation system 10 of the present invention further includes a quantity of reactive fluid disposed in reactive proximity with the cryogenic fluid being delivered into the desired area. Specifically, the delivered cryogenic fluid is structured to interact with the reactive fluid and at least partially cause a phase change in at least some of the reactive fluid. It is this phase change that is sufficient to result in the formation of the special effects cloud. In the preferred the reactive fluid includes water molecules, preferably in the form of water vapor molecules disposed in close proximity to the delivery ports 46 of the cryogenic fluid. In such an embodiment, the cryogenic fluid essentially freezes or sublimates the water molecules, that phase change resulting in the formation of the special effects cloud through the discoloration of each of the water molecules into a less transparent or often white, generally solid molecular form. Furthermore, this phase change is so extreme as a result of the use of the cryogenic fluid, that substantially little if any fluid condensation which would tend to make the desired area wet or damp will result. Moreover, it is also recognized that the phase change of the water molecules of the reactive fluid also results in a substantially rapid cooling of the desired area. As a result, it is seen that the effects generation system 10 of the present invention may, in some embodiments and environments function to provide a substantially rapid and effective cooling system for the particular area without resulting in the formation of moisture on individuals present and/or on other surfaces in the area.

In many environments and situations, based upon the humidity levels normally contained in ambient air, the reactive fluid of the reactive fluid source preferably includes the water molecules normally contained by the ambient air in the desired area into which the cryogenic fluid is delivered. Of course, however, in certain environments and/or climates, insufficient water molecules may be contained by the ambient air to provide the degree of cloud effect desired. Accordingly, in an alternate embodiment, and as illustrated in FIG. 1, a reactive fluid distribution assembly 50 is also preferably provided. In particular, the reactive fluid distribution assembly 50 is structured to generate and deliver the reactive fluid to the desired area, in preferably, but not necessarily, close, reactive proximity with the delivered cryogenic fluid, so as to result in the effective formation of the special effect cloud 58. Also in the illustrated embodiment, wherein the reactive fluid includes water molecules, the reactive fluid distribution assembly may include a steam generator. In such an embodiment, the reactive fluid distribution assembly 50 also preferably includes a distribution conduit 52 which delivers the reactive fluid into substantially close proximity to the delivery ports 46 of the delivery assembly 40. In this regard, the distribution conduit 52 is preferably disposed in generally spaced apart relation from the cryogenic fluid delivery conduit 42 such that a premature phase change does not result in the reactive fluid or the cryogenic fluid based on the proximity of the conduits. Moreover, the distribution conduit 52 is also preferably insulated, as at 53, to further prevent a premature phase change of the reactive fluid prior to its passage from the distribution conduit 52 through one or more distribution outlets 54. Still, however, the distribution outlets 54 are preferably disposed in substantially close relation to the cryogenic fluid deliver ports 46 so as to result in immediate interaction between the reactive fluid and the cryogenic fluid, and the formation of the special effects cloud 58. As can be appreciated, if desired, the amount of reactive fluid passing through the distribution outlets 54 may also be varied in order to vary the effect desired.

Looking to FIG. 2, in yet another embodiment of the present invention, the effect generation system 10 may also include a fluid collection assembly 60. In particular, the fluid collection assembly 60, which in the illustrated embodiment includes an expandable bladder, is structured to be disposed, at least temporarily, in fluid collecting engagement over one or more of the delivery ports 46 so as to collect a quantity of the cryogenic fluid therein. Moreover, the fluid collection assembly 60 is also preferably structured to abruptly release the collected quantities of cryogenic fluid into the desired area, such as through a rupturing of the expandable bladder. In particular, by the abrupt release of a large quantity of cryogenic fluid contained by the fluid collection assembly 60, a more concentrated and dramatic special effect cloud is created, also typically accompanied by a large noise, such as resulting from the rupturing of the fluid collection assembly 60 and the sudden release of cryogenic fluid. Of course, it is recognized that a baffle type structure and/or another configuration could be utilized so as to collect a quantity of cryogenic fluid 60 and result in its substantially abrupt release.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An effects generation system operative to produce a special effects cloud, said system comprising:

a) a cryogenic fluid source, including at least one container containing a quantity of a cryogenic fluid, b) said container including a fluid inlet and a fluid outlet each disposed in fluid communication with said cryogenic fluid within said container, c) a pressurization assembly connected to said fluid inlet and structured to maintain a substantially continuous outflow of said cryogenic fluid through said fluid outlet, d) a delivery assembly operatively connected to said fluid outlet and including an outlet assembly structured to deliver said cryogenic fluid into a predetermined area, and e) said pressurization assembly further structured to substantially equalize fluid flow pressure to said outlet assembly.

2. An effects generation system as recited in claim 1 wherein said outlet assembly is structured to deliver a substantially uniform delivery flow of said cryogenic fluid as a result of said substantially continuous outflow of said cryogenic fluid being maintain by said pressurization assembly.

3. An effects generation system as recited in claim 1 wherein said container includes a vacuum chamber structured to maintain said cryogenic fluid at least at a necessary temperature to maintain its cryogenic state.

4. An effects generation system as recited in claim 1 wherein said outlet assembly includes a plurality of delivery ports.

5. An effects generation system as recited in claim 4 wherein said pressurization assembly is structured to maintain a substantially continuous outflow of said cryogenic fluid so as to substantially equalize a fluid flow pressure at each of said plurality of delivery ports.

6. An effects generation system as recited in claim 5 wherein said plurality of delivery ports are structured to deliver a substantially uniform delivery flow of said cryogenic fluid as a result of said substantially continuous outflow of said cryogenic fluid being maintained by said pressurization assembly.

7. An effects generation system operative to produce a special effects cloud, said system comprising:

a) a cryogenic fluid source including a quantity of cryogenic fluid and a fluid outlet, b) a pressurization assembly connected to said cryogenic fluid source and structured to maintain a pressurized outflow of said cryogenic fluid through said fluid outlet, c) a delivery assembly connected to said fluid outlet and structured to deliver said cryogenic fluid into a predetermined area, and d) said pressurization assembly comprising a pressure regulator disposed and structured to regulate the pressure of said pressurized outflow of cryogenic fluid through said fluid outlet.

8. An effects generation system as recited in claim 7 wherein said pressurization assembly includes a pressurized fluid source connected in fluid communication with said cryogenic fluid source through said pressure regulator.

9. An effects generation system as recited in claim 8 wherein said pressurized fluid source is structured to direct a substantially continuous flow of pressurized fluid to said cryogenic source and maintain a substantially continuous pressurized outflow of said cryogenic fluid through said fluid outlet.

10. An effects generation system as recited in claim 9 further comprising a quantity of reactive fluid disposed in the predetermined area in reactive proximity with said cryogenic fluid.

11. An effects generation system operative to produce a special effects cloud, said system comprising:

a) a cryogenic fluid source including a quantity of cryogenic fluid and a fluid outlet, b) a pressurization assembly connected to said cryogenic fluid source and structured to maintain a pressurized outflow of said cryogenic fluid through said fluid outlet, c) a delivery assembly connected to said fluid outlet and structured to deliver said cryogenic fluid into a predetermined area, d) said delivery assembly comprising a plurality of delivery ports collectively disposed in a predetermined array, said predetermined array being disposed to deliver said cryogenic fluid in a defined pattern, and e) a quantity of reactive fluid disposed in said predetermined area in reactive proximity with said cryogenic fluid.

12. An effects generation system as recited in claim 11 wherein said delivery assembly further comprises at least one delivery conduit interconnecting said cryogenic fluid source and said plurality of delivery ports.

13. An effects generation system as recited in claim 12 wherein said delivery conduit is at least partially vacuum jacketed so as to substantially maintain a necessary temperature of said cryogenic fluid.

14. An effects generation system operative to produce a special effects cloud, said system comprising:

a) a cryogenic fluid source including a quantity of cryogenic fluid and a fluid outlet, b) a pressurization assembly connected to said cryogenic fluid source and structured to maintain a pressurized outflow of said cryogenic fluid through said fluid outlet, c) a delivery assembly connected to said fluid outlet and structured to deliver said cryogenic fluid into a predetermined area, d) a distribution assembly structured to deliver a source of reactive fluid to said predetermined area in reactive proximity to said cryogenic fluid delivery to said predetermined area, and e) said distribution assembly being at least partially insulated from said cryogenic fluid within said delivery assembly so as to minimize a premature phase change in said reactive fluid prior to delivery thereof to said predetermined area.

15. An effects generation system as recited in claim 14 wherein said distribution assembly comprises at least one delivery conduit structured to deliver said reactive fluid to the predetermined area, said delivery conduit being substantially insulated from said delivery assembly.

16. An effects generation system as recited in claim 15 wherein said distribution assembly comprises at least one delivery port disposed in communicating relation to the predetermined area.

17. An effects generation system as recited in claim 16 further comprising a fluid collection assembly structured to be disposed in at least temporary fluid collecting relation to said delivery port, said fluid collection assembly structured to collect a quantity of said cryogenic fluid therein and to substantially abruptly release said quantity of said cryogenic fluid into the predetermined area.

18. An effects generation system as recited in claim 17 wherein said fluid collection assembly comprises an expandable bladder.

19. An effects generation system as recited in claim 18 wherein said expandable bladder is structured to rupture so as to result in said substantially abrupt release of said quantity of cryogenic fluid into the predetermined area.

* * * * *